US012742324B2

(12) United States Patent
Bailey

(10) Patent No.: US 12,742,324 B2
(45) Date of Patent: Sep. 22, 2026

(54) PURLIN CONSTRUCTION WITH WATER FLOW SYSTEM FOR FLAT PANELS

(71) Applicant: Zachary Bailey, Strasburg, CO (US)

(72) Inventor: Zachary Bailey, Strasburg, CO (US)

( * ) Notice: Subject to any disclaimer, the term of this patent is extended or adjusted under 35 U.S.C. 154(b) by 164 days.

(21) Appl. No.: 18/242,767

(22) Filed: Sep. 6, 2023

(65) Prior Publication Data

US 2024/0076873 A1 Mar. 7, 2024

Related U.S. Application Data

(60) Provisional application No. 63/404,230, filed on Sep. 7, 2022.

(51) Int. Cl.

| | |
|---|---|
| ***E04C 3/07*** | (2006.01) |
| ***E04D 3/36*** | (2006.01) |
| ***E04D 13/04*** | (2006.01) |
| ***E04D 13/064*** | (2006.01) |
| *E04C 3/04* | (2006.01) |

(52) U.S. Cl.

CPC ..... *E04C 3/07* (2013.01); *E04D 3/36* (2013.01); *E04D 13/04* (2013.01); *E04D 13/064* (2013.01); *E04C 2003/0413* (2013.01); *E04C 2003/0443* (2013.01); *E04D 13/0477* (2013.01)

(58) Field of Classification Search

CPC ..... E04C 3/07; E04C 2003/0413; E04C 2003/0443; E04D 3/36; E04D 13/04; E04D 13/064; E04D 13/0477

See application file for complete search history.

(56) References Cited

U.S. PATENT DOCUMENTS

| | | | | | |
|---|---|---|---|---|---|
| 1,545,168 | A * | 7/1925 | Schenck | E04C 3/07 | 52/842 |
| 1,833,043 | A * | 11/1931 | Sheldon | E04C 3/07 | 72/368 |
| 2,082,792 | A * | 6/1937 | Dean | B64C 1/065 | 52/840 |
| 2,125,691 | A * | 8/1938 | Ragsdale | E04C 3/07 | 52/839 |
| 2,125,692 | A * | 8/1938 | Ragsdale | E04C 3/07 | 29/897.35 |

(Continued)

FOREIGN PATENT DOCUMENTS

| | | | | |
|---|---|---|---|---|
| CA | 2233111 | A1 * | 11/1998 | |
| CN | 109577570 | A * | 4/2019 | E04B 1/66 |

(Continued)

*Primary Examiner* — Jessie T Fonseca

(74) *Attorney, Agent, or Firm* — Accelerate IP LLC

(57) ABSTRACT

At least one first vertical member having an upper portion and a lower portion wherein the lower portion has at least one first horizontal member extending away from the at least one first vertical member. At least one vertical second vertical member extends vertical from the at least one first horizontal member. At least one second horizontal member extending from the at least one first upright member on the upper portion and at least one third vertical member extending from the at least one second horizontal member and at least one third horizontal member extending from the at least one third vertical member wherein the at least one third horizontal member forms a shelf with at least one gutter.

7 Claims, 7 Drawing Sheets

(56) References Cited

U.S. PATENT DOCUMENTS

| | | | | | |
|---|---|---|---|---|---|
| 2,454,604 | A * | 11/1948 | Heim | E04C 3/07 | 52/377 |
| 10,597,864 | B1 * | 3/2020 | Pearson | E04B 5/40 | |
| 2003/0037501 | A1 * | 2/2003 | Lutrario | E04C 3/06 | 52/765 |
| 2008/0000178 | A1 * | 1/2008 | Hsu | E04B 5/40 | 52/745.19 |
| 2011/0247297 | A1 * | 10/2011 | Bae | E04C 3/291 | 52/846 |
| 2016/0108617 | A1 * | 4/2016 | Powers, III | E04D 13/1612 | 29/897.3 |
| 2020/0115906 | A1 * | 4/2020 | Jones | E04D 13/0645 | |
| 2021/0270039 | A1 * | 9/2021 | Jones | E04H 6/42 | |

FOREIGN PATENT DOCUMENTS

| | | | | | |
|---|---|---|---|---|---|
| CN | 110735544 | A * | 1/2020 | | |
| CN | 111173208 | A * | 5/2020 | | |
| CN | 113006380 | A * | 6/2021 | E04B 7/00 | |
| CN | 114182891 | A * | 3/2022 | | |
| DE | 102015222885 | A1 * | 5/2017 | B21D 39/031 | |
| JP | 2012087519 | A * | 5/2012 | | |
| WO | WO-9745605 | A1 * | 12/1997 | E04B 9/005 | |
| WO | WO-2009073914 | A1 * | 6/2009 | E04B 1/24 | |

* cited by examiner

PURLIN CONSTRUCTION WITH WATER FLOW SYSTEM FOR FLAT PANELS

CROSS REFERENCE TO RELATED APPLICATION

This application claims benefit from currently pending U.S. Provisional Application No. 63/404,230 titled "purlin construction with water flow system for flat panels" and having a filing date of Sep. 7, 2022, all of which is incorporated by reference herein.

FIELD OF THE INVENTION

The present specification relates purlin support for flat panel and more specifically a purlin support that incorporates a water retentions system that redirects water from the panels.

BACKGROUND OF THE INVENTION

It is common in the art for individuals to park under or sit under a shade structure. These structures are typically made from metal roof structures and even more recently solar panels are now being mounted on top of these structures to provide shade and power. These panels are mounted to purlins which usually have an upper flat surface that the panels are mounted to and a lower flat portion that mounts to the beam of the structure. Purlins have been a fundamental element in construction for centuries, offering horizontal support for roofing and cladding materials. Traditionally, purlins have been manufactured from various materials, including wood, steel, and concrete.

Traditional purlin designs and installation methods have often relied on standard practices that have been in use for decades. While these traditional approaches have served their purpose, there exists room for improvement in terms of structural integrity, installation efficiency, and adaptability to different building designs and materials. One of the main problems with current purlins is that it is difficult and time consuming to attach the panels to the purlins and they usually require some type of secondary attachment mechanism such as bolts or screws which can damage the solar panel. This type of installation is very time consuming and introduce error within the installation process that can damage the panels.

Other prior art, such as, U.S. Pat. No. 8,857,133 attempts to fix this issue by forming an opening or channel that allows the panels to slide within the purlin locking the panel between a two outwardly extending members. This channel runs the length of the purlin which can cause problems if a panel needs to be replaced. The replacement technique requires all the panels to be removed from the purlin up to the broken panel and then slide back into the panel once the broken panel is replaced. In addition, this type of purlin creates gaps between the panels that allows water to seep through and drip on the cars or individuals beneath during storms. Another problem created in areas that snow is that when snow melts and then freezes the puddles created under these panels creates an ice rink under the structure causing dangerous situation for both cars and people walking under the structure.

Therefore, it would be highly advantageous to remember the foregoing with a new and improved purlin for roof structures that provides a gutter system that collects and then directs the water away from under the structure.

It is another objective of the present invention to provide a new and improved purlin that allows the panels or roof structures to be easily installed and removed if a panel is damaged.

It is another objective of the present invention to provide new and improved purlin that can be quickly and easily attached utilizing a gutter system incorporated within the purlin.

BRIEF SUMMARY OF THE INVENTION

Accordingly, an elongated purling having at least one first vertical member which can have an upper portion and a lower portion wherein the lower portion can have at least one first horizontal member extending away from the at least one first vertical member. At least one vertical second vertical member can extend vertical from the at least one first horizontal member. At least one second horizontal member can extend from the at least one first upright member on the upper portion and at least one third vertical member extending from the at least one second horizontal member and at least one third horizontal member extending from the at least one third vertical member wherein the at least one third horizontal member can form a shelf.

At least one gutter can be formed by the at least one first upright member and the at least one third vertical member. At least one fourth vertical member can extend from the first vertical member and second horizontal member wherein the first, second third and fourth vertical member can have a length and the first, second, and third horizontal member can have the same length. A second gutter can be formed by the at least one first vertical member and the at least one second vertical member. The fourth vertical member can have a clip to attach a panel mount to. The at least one third vertical member and at least one third horizontal member can form a shelf. The at least one first horizontal member can be attached to a structural member by a plurality of fasteners.

An elongated purlin can comprise a flat panel formed into a support that can have a top section configured to couple to a structure to be supported. A top vertical member can extend from the top section that can define a first side of the flat panel and a second side of the flat panel. A first bend that can extend the panel horizontally from the top vertical member to form a first channel on the first side. A double back bend that can bend to the panel to double back along the portion of the panel that can extend to form the first channel. A second bend that can direct the panel to extend horizontally from the first vertical member to form a second channel on the second side. A second double back bend that can bend the panel to double back along the portion of the panel that extends to form the second channel.

A main vertical member that can extend from the second channel. A third bend that extends the panel horizontally from the main vertical member to from a third channel on the first or second side. The top section is coupled to the structure to be supported by a clipping mechanism. The elongated purlin wherein at least one of the first bend and the second bend can extend the panel substantially orthogonally to the top vertical member to define a channel floor and wherein the first gutter or the second gutter can comprise a wall bend that directs the panel in a direction orthogonal to the channel floor to define a channel wall.

The main vertical member can have a groove which acts as a stiffening member. The elongated purlin can be manufactured from one single piece or multiple pieces. The elongated purlin can be made from stainless steel, carbon steel or aluminum. The elongated purlin can further comprise a fourth bend that extends the panel horizontally from the main vertical member to form a fourth channel on the side opposite the third channel. The at least one of the first, second, and third bends can extend the panel from the vertical member at a non-orthogonal angle.

An elongated purlin comprising a flat panel formed into a support having a top section configured to couple to a structure to be supported. A top vertical member can extend from the top section that can define a first side of the flat panel and a second side of the flat panel. A first bend that can extend the panel horizontally from the top vertical member to form a second gutter on the first side. A double back bend that bends the panel to double back along the portion of the panel that extends to form the second gutter. A second bend that can direct the panel to extend horizontally from the first vertical member to form a third gutter on the second side. A second double back bend that bends the panel to double back along the portion of the panel that extends to form the third gutter. A main vertical member that can extend from the second gutter. A third bend that extends the panel horizontally from the main vertical member to from a first gutter on the first or second side. The top section can be coupled to the structure to be supported by a clipping mechanism.

The at least one of the first bend and the second bend extend the panel substantially orthogonally to the top vertical member to define a gutter floor and wherein the first gutter or the second gutter comprises a wall bend that directs the panel in a direction orthogonal to the channel floor to define a gutter wall. The main vertical member can have a groove which acts as a stiffening member. The elongated purlin can be manufactured from one single piece or multiple pieces. The elongated purlin can be made from stainless steel, carbon steel or aluminum. The elongated purlin can further comprise a fourth bend that extends the panel horizontally from the main vertical member to form a fourth gutter on the side opposite the first gutter. The at least one of the first, second, and third bends extend the panel from the vertical member at a non-orthogonal angle.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the. Absent such clear statements of intent to apply a "special" definition, it is the inventor's intent and desire that the simple, plain, and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112 (f). Thus, the use of the words "function," "means" or "step" in the Detailed Description or Description of the Drawings or claims is not intended to somehow indicate a desire to invoke the special provisions of 35 U.S.C. § 112 (f), to define the invention. To the contrary, if the provisions of 35 U.S.C. § 112 (f) are sought to be invoked to define the inventions, the claims will specifically and expressly state the exact phrases "means for" or "step for" and will also recite the word "function" (i.e., will state "means for performing the function of . . . , without also reciting in such phrases any structure, material or act in support of the function. Thus, even when the claims recite a "means for performing the function of molding a . . . , step for performing the function of molding a . . . ," if the claims also recite any structure, material or acts in support of that means or step, or that perform the recited function, then it is the clear intention of the inventors not to invoke the provisions of 35 U.S.C. § 112 (f). Moreover, even if the provisions of 35 U.S.C. § 112 (f) are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

Additional features and advantages of the present specification will become apparent to those skilled in the art upon consideration of the following detailed description of the illustrative embodiment exemplifying the best mode of carrying out the invention as presently perceived.

BRIEF DESCRIPTION OF THE DRAWINGS

These and other features, aspects, and advantages of the present specification will become better understood with regard to the following description, appended claims, and accompanying drawings where:

Elements and acts in the figures are illustrated for simplicity and have not necessarily been rendered according to any particular sequence or embodiment.

DETAILED DESCRIPTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the inventions is not limited to the examples that are described below.

Figure 1:
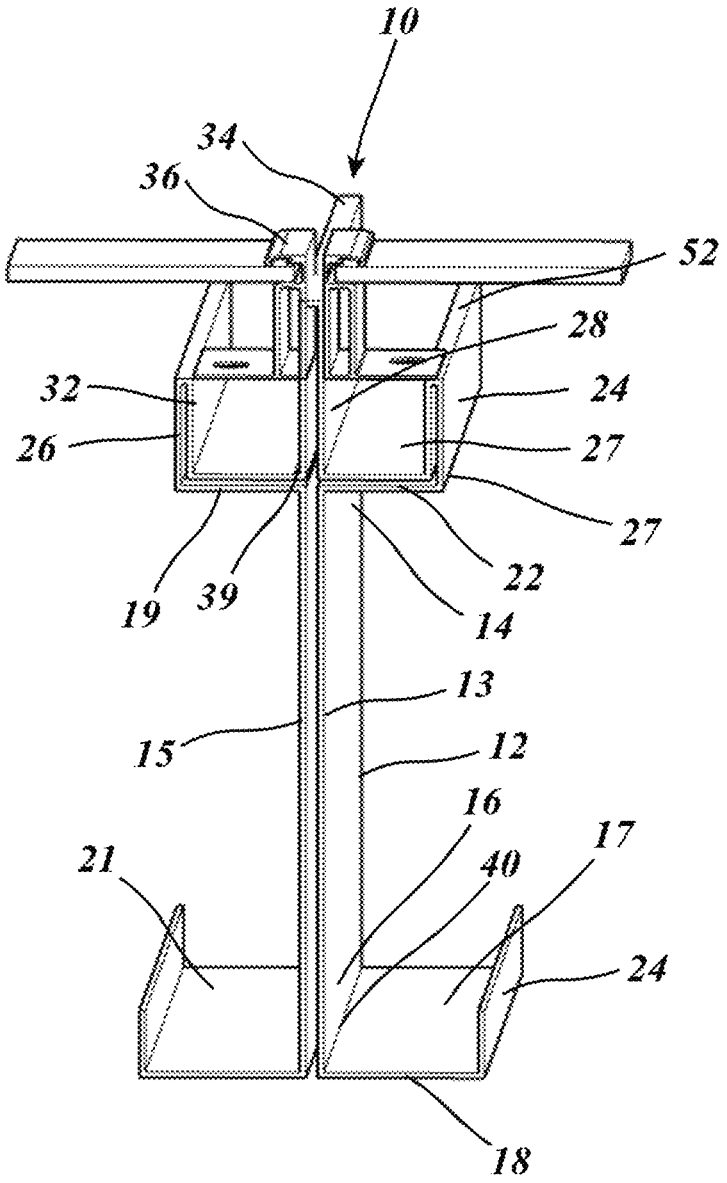
FIG. 1 is an isometric view of the improved purlin with the water gutter system in accordance to one, or more embodiments.
Figure 2:
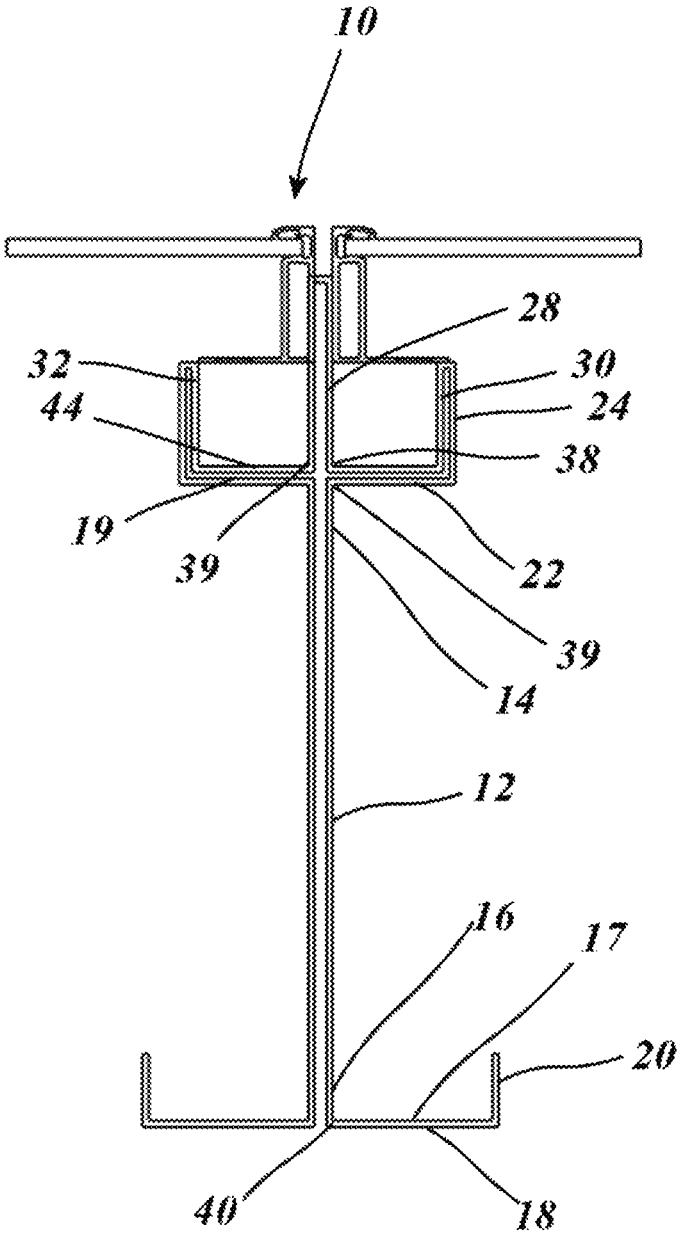
FIG. 2 is a front view of the improved purlin with the water gutter system in accordance to one, or more embodiments.
Figure 7:
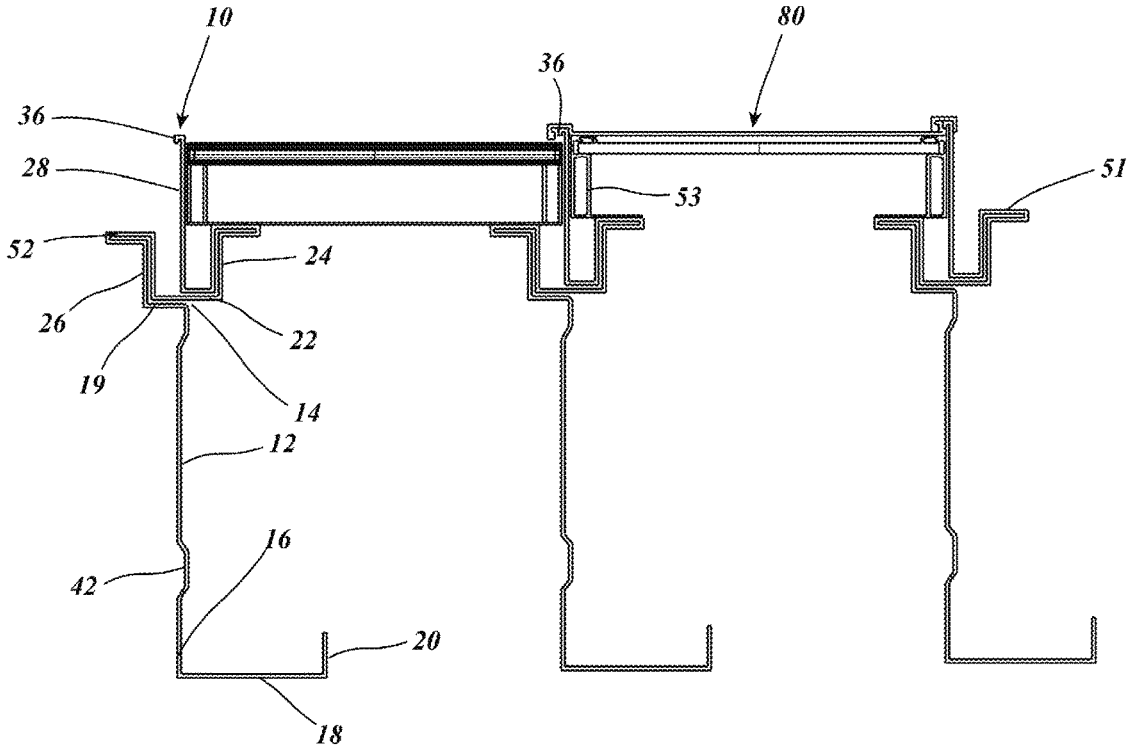
FIG. 7 is a front view of the improved purlin with the water gutter system with the panels installed in accordance to one, or more embodiments.
Figure 8:
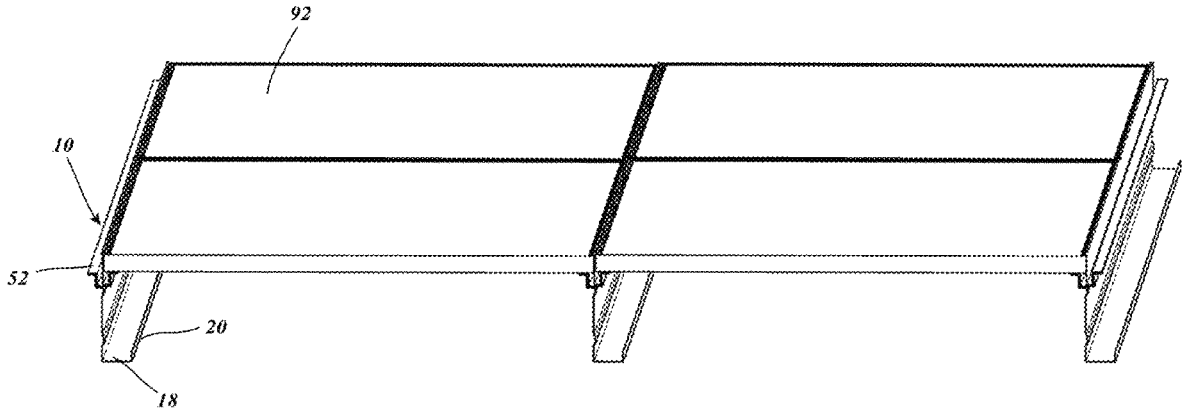
FIG. 8 is an isometric view of the improved purlin with the water gutter system with panels installed in accordance to one, or more embodiments.

Referring initially to FIG. 1-2, an elongated purlin 10 having at least one first vertical member 12 defining a first side 13 and a second side 15 wherein the first vertical member can have an upper portion 14 and a lower portion 16. A first horizontal member 18 can extend from the lower portion 16 bending from the first vertical member and extending away from the first vertical member which can define a first gutter 17. The first vertical member 12 and first horizontal member 18 can have such as, for example, a sharp, a radiused, a chamfered corner, welded or the like corner. The first vertical member 12 and first horizontal member 18 can extend longitudinally the entire length of the elongated purlin 10. In certain embodiments, the first vertical member 12 can have a groove 42, as shown in FIG. 7, substantially near its lower portion 16 wherein the groove can extend longitudinally the entire length of the elongated purlin 10. The groove 42 can act as a structural strengthening component to help strengthen the first vertical member 12.

In embodiments, the at least one first horizontal member 18 can have at least one third vertical member 20 bending from and extending away from the vertical member forming the first gutter 17 wherein the first gutter can mount to beam (not shown) by a plurality of fasteners (not shown) wherein the beam can be an I-beam or the like. The fasteners can have a grommet, O-ring, seal, or the like to seal the fastener to the gutter to stop water leaking through the holes. In certain embodiments, the third vertical member 20 can be omitted but in the preferred embodiment a first gutter 17 can be formed by the first vertical member 12 and the third vertical member 20 creating a flow path for the water to flow if any water escapes from a second gutter 27. The first gutter 17 and the second gutter 27 can extend longitudinally the entire length of the elongated purlin 10 wherein on one end or both ends the purlin can be attached to a gutter system (not shown) wherein the gutter system can be connected to each purlin row and can direct the run-off water to a central location such as, the front corner, back corner or the like of the structure.

In embodiments, at least one second horizontal member 22 can bend from and extend from the first vertical member 12 substantially near the upper portion 14 on the first side to at least partially define the second gutter 27 and a third horizontal member 19 extending from the upper portion on the second side. The second horizontal member 22 can have such as, for example, a sharp, a radiused, chamfered or the like transition from the first vertical member 12. The first horizontal member 18 can extend longitudinally the entire length of the elongated purlin 10. At least one second vertical member 24 can bend from or be welded on and extend from the second horizontal member 22 wherein the second horizontal member 22 can transition into the second vertical member 24 by such as, for example, a radius, chamfer, sharp corner, or the like. In certain embodiments the second side 15 can be a mirrored opposite of the first side 13. The second vertical member 24 can extend from the second horizontal member 22 and the third horizontal member 19 wherein the second vertical member is configured to couple to the structure to be supported.

Figure 3:
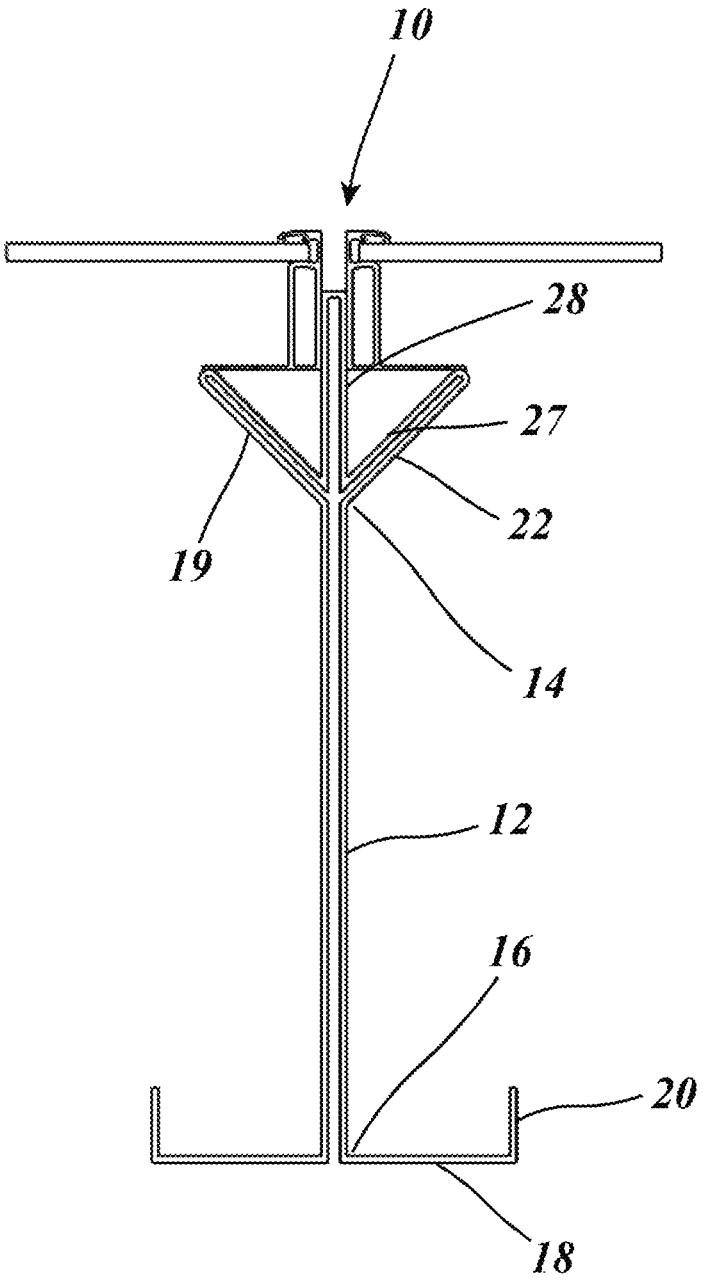
FIG. 3 is a front view of another embodiment of the improved purlin with the water gutter system in accordance to one, or more embodiments.
Figure 4:
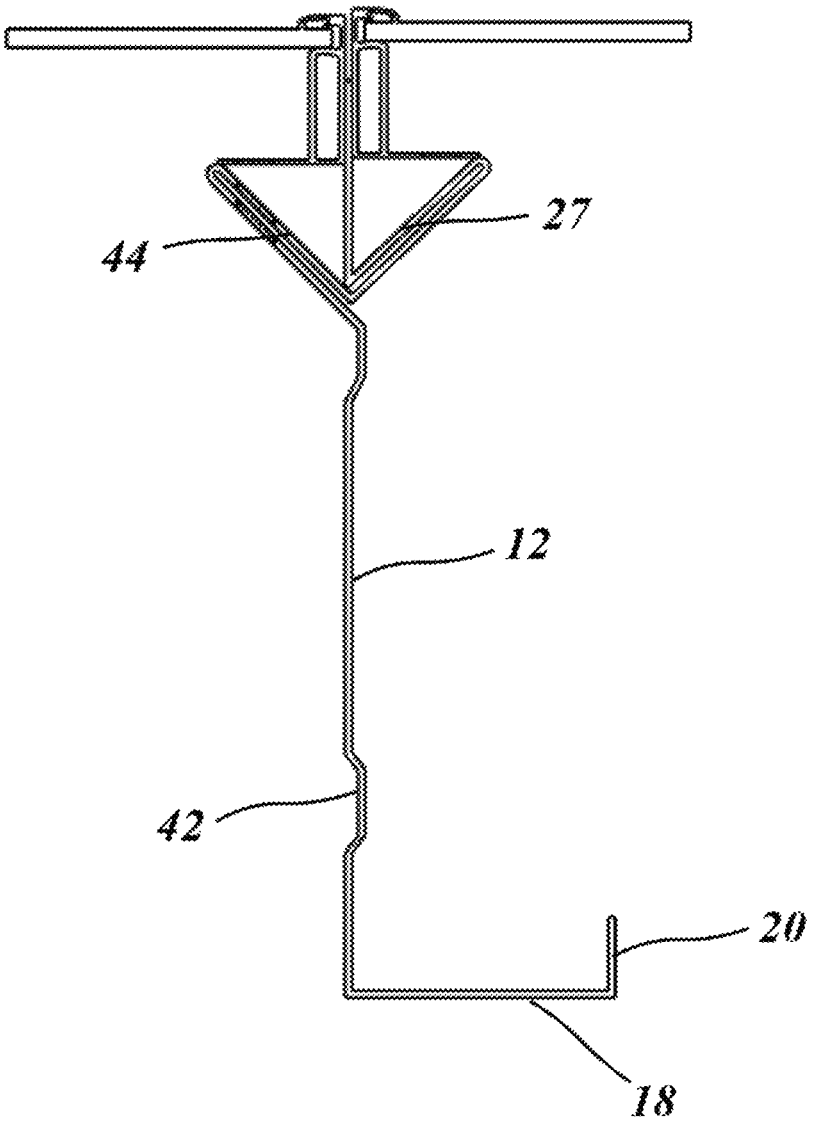
FIG. 4 is a front view of another embodiment of the improved purlin with the water gutter system in accordance to one, or more embodiments.
Figure 5:
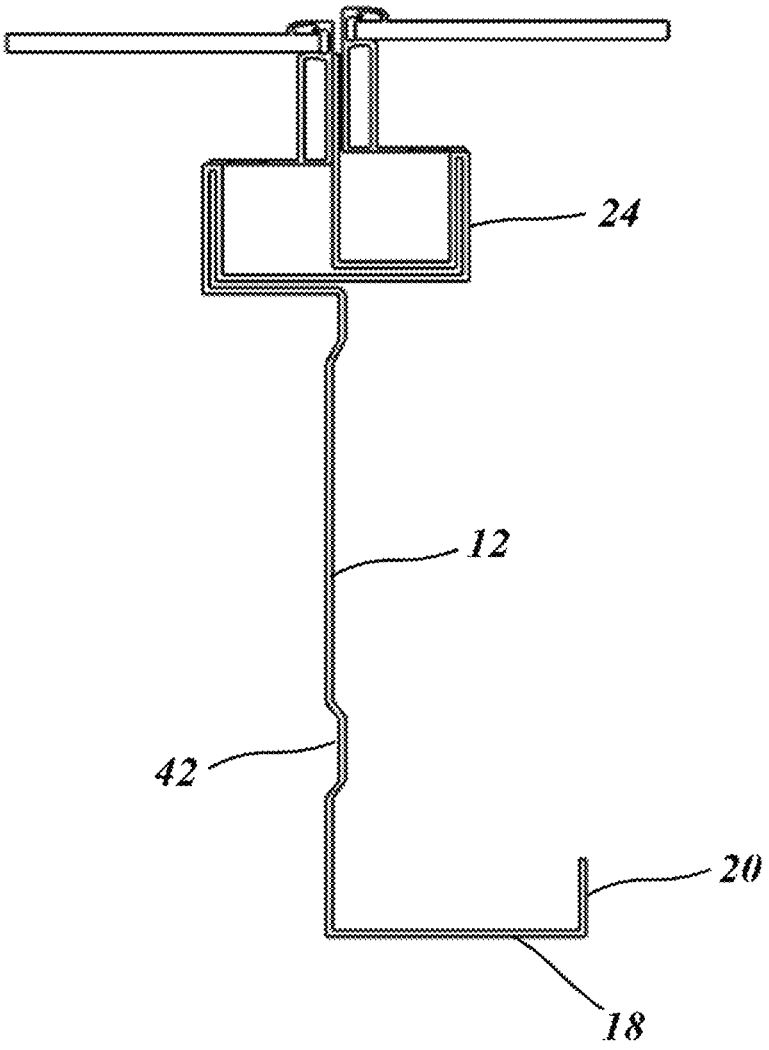
FIG. 5 is a front view of another embodiment of the improved purlin with the water gutter system in accordance to one, or more embodiments.
Figure 6:
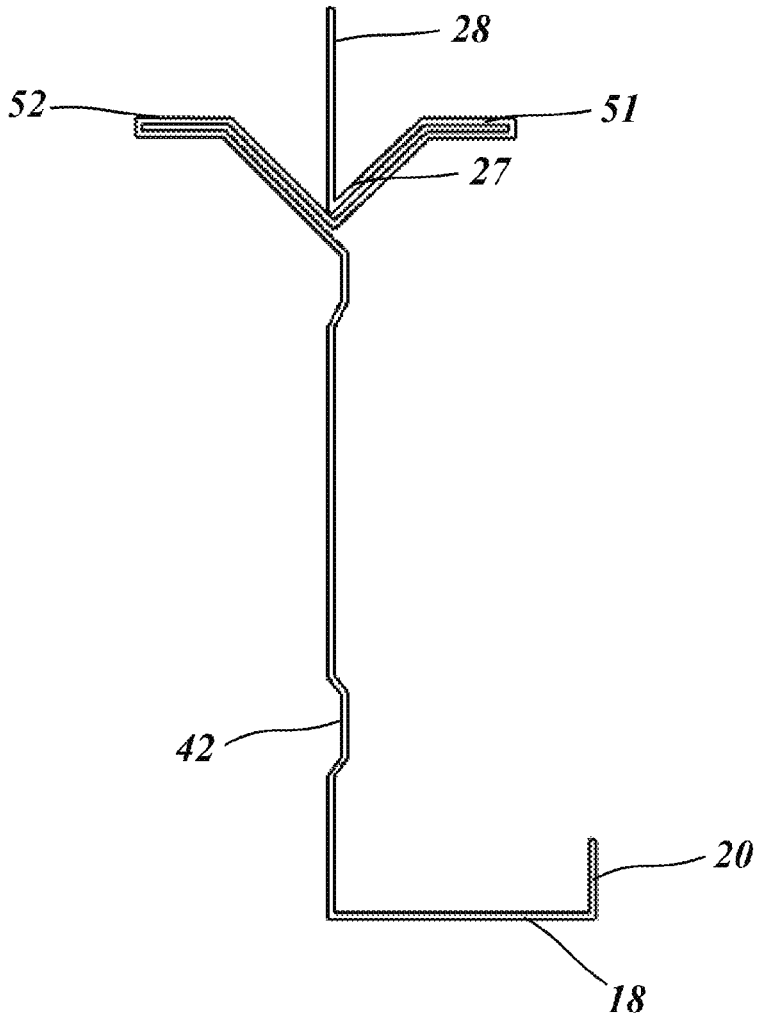
FIG. 6 is a front view of another embodiment of the improved purlin with the water gutter system in accordance to one, or more embodiments.

In embodiments, the second horizontal member 22, third horizontal member 19 and the second vertical member 24 can form a second gutter 27 wherein the gutter can catch and redirect the water runoff from the panels directing the water to one side of the structure and allowing the water to run off a central location. The second gutter 27 can be a V-shape as shown in FIG. 3, FIG. 4, and FIG. 6 or U-shape as shown in FIG. 1, FIG. 2, FIG. 5, FIG. 7, and FIG. 8, or any other shape that can form a channel that creates a gutter system for water flow. The elongated purlin 10 can further comprise a first wall member 20, extending vertically from the first horizontal member 18 to define the first gutter 17, a second wall member 30 extending from the second horizontal member 22 to define the second gutter 27, and a third wall member 32 extending from the third horizonal member 51.

The at least one second vertical member 24 can be bent into and extend into a third horizontal member 51, and the third vertical member 25 can be bent into and extend into a fifth horizontal member 52, wherein the third horizontal member 51, and the fifth horizontal member 52 can be configured to couple to the structure to be supported. The third horizontal member 51 and its associated offset member as mentioned below can be a mounting shelf wherein the panel can be mounted directly to the mounting shelf by at least one fastener such as a panel strap, bolts, screws, or the like. In other embodiments, a panel platform 53, as shown in FIG. 7, can be attached to the mounting shelf 51, 52 wherein the panel platform can sit atop the fourth vertical member 26 which can allow a panel strap 80 to secure the panel to the purlin 10. The top vertical member 28 can have a clip 36 either bent into it or attached to it to allow for the panel strap 80 to snap onto the clip securing the panels 92 to the purlin 10. The clip 36 can be such as, for example, a strut channel, snap in hanger, quick connect clamp, strut mount, custom clamp, or the like. In other embodiments, the top vertical member 28 can have the clip omitted and the panel strap 80 can be bolted to the purlin 10.

The elongated purlin 10 can be formed from a single strip of sheet metal wherein each vertical and horizontal members are bent back upon itself create a mirror opposite offset member from each member as shown in FIG. 1 through FIG. 6. In certain embodiments, the opposite member can be welded instead of a single strip, but the preferred method is a single strip of sheet metal for simplicity and strength. In embodiments, the purlin can be formed from a single strip wherein the strip can start its bend at any point on the purlin but in the preferred the strip can start its bend on the third vertical member 20 into the first horizontal member 18 then into the first vertical member 12 into the second horizontal member 22 into the second vertical member 24 and then into the third horizontal member 51 and then bent back onto itself form offset member from the third horizontal member 51 to the second vertical member 24 to the second horizontal member and then bent to extend vertically to form a top vertical member 28 and then bent to form the mirror image as shown in FIG. 2. In certain embodiments, the second horizontal member 22 can be horizontal with a third vertical member 24, or it can form a v-channel, or the like creating the main channel for the water run-off.

In certain embodiments, the elongated purlin 10 can start its bend on the third vertical member 20 into the first horizontal member 18 then into the first vertical member 12 wherein the first vertical member can be bent into fourth horizontal member 19 to the fourth vertical member 26, and then bent to form the third horizontal member 52 and then bent back around the mirror opposite members and extend to form the second horizontal member 22, third vertical member 24, third horizontal member 51 and then bent back on itself forming an offset member from the third horizontal member 51, third vertical member and partially the second horizontal member and then bent to form the top vertical member 28 as shown in FIG. 7. The bent back section can be bent parallel with a corresponding offset section and in an overlying position of corresponding opposite member.

In other embodiments, the members can be manufactured from a one single strip as mentioned above or can be multiple pieces welded together creating each member. In the preferred embodiment the purlin 10 is formed from one elongated strip of sheet metal by bending it multiple times to form each member or in other embodiments the purlin can be mad from multiple pieces welded together to form one piece. In embodiments the elongated purlin 10 can be manufactured from such as, for example, carbon steel, stainless steel, aluminum, titanium, plastic or the like.

An elongated purlin 10 can comprise a flat panel formed into a support that can have a top section 34 configured to couple to a structure to be supported. A top vertical member 28 can extend from the top section 34 that can define a first side 13 of the flat panel and a second side 15 of the flat panel. A first bend 38 that can extend the panel horizontally from the top vertical member 28 to form a second gutter 27 on the first side 13. A double back bend that can bend to the panel to double back along the portion of the panel that can extend to form the second gutter 27. A second bend 39 that can direct the panel to extend horizontally from the first vertical member 12 to form a third gutter 44 on the second side 15. A second double back bend that can bend the panel to double back along the portion of the panel that extends to form the third gutter 44. A main vertical member 12 that can extend from the second gutter 27. A third bend 40 that extends the panel horizontally from the main vertical member 12 to from a first gutter 17 on the first side 13 or the second side 15.

The top section 34 is coupled to the structure to be supported by a clipping mechanism 36. The elongated purlin 10 at least one of the first bend 38 and the second bend 39 can extend the panel substantially orthogonally to the top vertical member 28 to define a channel floor and wherein the first gutter or the second gutter can comprise a wall bend that directs the panel in a direction orthogonal to the channel floor to define a channel wall.

The main vertical member 12 can have a groove 42 which acts as a stiffening member. The elongated purlin 10 can be manufactured from one single piece or multiple pieces. The elongated purlin 10 can be made from stainless steel, carbon steel or aluminum. The elongated purlin 10 can further comprise a fourth bend 41 that extends the panel horizontally from the main vertical member to form a fourth gutter 21 on the side opposite the first gutter 17. The at least one of the first 38, second 39, and third bends 40 can extend the panel from the vertical member at a non-orthogonal angle. The first gutter 17, second gutter 27, third gutter 44 and fourth gutter 21 can be such as, for example, channel, u-shaped, v-shaped, or the like.

In closing, it is to be understood that although aspects of the present specification are highlighted by referring to specific embodiments, one skilled in the art will readily appreciate that these disclosed embodiments are only illustrative of the principles of the subject matter disclosed herein. Therefore, it should be understood that the disclosed subject matter is in no way limited to a particular methodology, protocol, and/or reagent, etc., described herein. As such, various modifications or changes to or alternative configurations of the disclosed subject matter can be made in accordance with the teachings herein without departing from the spirit of the present specification. Lastly, the terminology used herein is for the purpose of describing particular embodiments only and is not intended to limit the scope of the present disclosure, which is defined solely by the claims. Accordingly, embodiments of the present disclosure are not limited to those precisely as shown and described.

Certain embodiments are described herein, including the best mode known to the inventors for carrying out the methods and devices described herein. Of course, variations on these described embodiments will become apparent to those of ordinary skill in the art upon reading the foregoing description. Accordingly, this disclosure includes all modifications and equivalents of the subject matter recited in the claims appended hereto as permitted by applicable law. Moreover, any combination of the above-described embodiments in all possible variations thereof is encompassed by the disclosure unless otherwise indicated herein or otherwise clearly contradicted by context.

What is claimed is:

1. An elongated purlin for use with a structure to be supported, the elongated purlin comprising:
- a single strip of material bent to comprise:
- a first vertical member and a top vertical member that together define a first side and a second side;
  - a first horizontal member and a wall member that together with the first vertical member defines a first gutter on the first side;
  - a second horizontal member that together with the top vertical member defines a second gutter on the first side, wherein the top vertical member extends vertically beyond the second horizontal member;
  - a third horizontal member extending horizontally from the second gutter and serving as a mounting shelf;
  - a double back bend that bends the strip to double back along the portion of the second horizontal member that extends to form the second gutter;
- fourth horizontal member that together with the top vertical member defines a third gutter on the second side.

2. The elongated purlin according to claim 1, further comprising a clipping mechanism configured to clip to the structure to be supported.

3. The elongated purlin according to claim 1, wherein each gutter has a gutter floor and wherein the gutter floor of the first gutter or the second gutter extends in a direction orthogonal to the first vertical member or the top vertical member.

4. The elongated purlin according to claim 1, wherein the first vertical member has a groove which acts as a stiffening member.

5. The elongated purlin according to claim 1, wherein the elongated purlin is made from stainless steel, carbon steel or aluminum.

6. The elongated purlin according to claim 1 further comprising a fourth gutter on the side opposite the first gutter.

7. The elongated purlin according to claim 1 wherein the first vertical member meets the second horizontal member at a first bend, the second horizontal member meets with the top vertical member at a second bend, and wherein the fourth horizontal member meets the top vertical member at a third bend, and wherein at least one of the first bend, the second bend, and the third bend is at a non-orthogonal angle.

* * * * *